US007184691B2

(12) United States Patent
Kita et al.

(10) Patent No.: US 7,184,691 B2
(45) Date of Patent: Feb. 27, 2007

(54) TONER CONTAINER, TONER SUPPLY DEVICE AND IMAGE FORMING APPARATUS

(75) Inventors: Emi Kita, Tokyo (JP); Takeroh Kurenuma, Yokosuka (JP); Kiyonori Tsuda, Yokohama (JP); Masayuki Yamane, Zama (JP); Nobuyuki Taguchi, Kawasaki (JP); Kazuhisa Sudo, Kawasaki (JP); Satoshi Narumi, Yokohama (JP); Fumio Ogata, Fuji (JP); Seiji Terazawa, Mishima (JP); Kenzo Tatsumi, Toyonaka (JP); Keisuke Katoh, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/255,872

(22) Filed: Oct. 24, 2005

(65) Prior Publication Data

US 2006/0099012 A1 May 11, 2006

(30) Foreign Application Priority Data

Nov. 9, 2004 (JP) ..... 2004-324976
Nov. 15, 2004 (JP) ..... 2004-331142
Dec. 28, 2004 (JP) ..... 2004-380959

(51) Int. Cl.
*G03G 15/08* (2006.01)

(52) U.S. Cl. ..... 399/119; 399/120; 399/262

(58) Field of Classification Search ..... 399/262, 399/119, 120
See application file for complete search history.

(56) References Cited

U.S. PATENT DOCUMENTS 5,345,297 A 9/1994 Katakabe et al.
6,603,939 B1 * 8/2003 Toba et al. ..... 399/103
2002/0061205 A1 * 5/2002 Tsuda et al. ..... 399/111
2002/0076235 A1 * 6/2002 Matsuzaki ..... 399/111
2004/0126144 A1 * 7/2004 Yoshino et al. ..... 399/262
2004/0146320 A1 * 7/2004 Sudo et al. ..... 399/258

FOREIGN PATENT DOCUMENTS

DE 102 23 232 A1 12/2003
EP 1 006415 A1 6/2000
EP 1 154 335 A1 11/2001
JP 8-6369 1/1996
JP 2001-324863 11/2001

* cited by examiner

*Primary Examiner*—David M. Gray
*Assistant Examiner*—Geoffrey T Evans
(74) *Attorney, Agent, or Firm*—Oblon, Spivak, McClelland, Maier & Neustadt, P.C.

(57) ABSTRACT

A toner container for installation in a toner supply device is provided. The toner container includes a toner accommodation member and a cap member freely attachable to and detachable from the toner accommodation member. The toner accommodation member includes a bag member having an opening, and a connection member attached to the opening of the bag member and having a toner supply opening. The cap member is configured to receive toner supplied from the toner supply opening of the connection member of the toner accommodation member and to discharge the received toner. Either of the connection member of the toner accommodation member and the cap member includes a groove part and the other includes a protrusion part to engage with the groove part, and the cap member is attached to the toner accommodation member by engaging the groove part and the protrusion part with each other. The protrusion part elastically deforms to engage with the groove part.

27 Claims, 14 Drawing Sheets

ENGAGED STATE

TONER CONTAINER, TONER SUPPLY DEVICE AND IMAGE FORMING APPARATUS

CROSS-REFERENCE TO RELATED APPLICATIONS

The present application claims priority and contains subject matter related to Japanese Patent Applications No. 2004-324976, No. 2004-331142, and No. 2004-380959 filed in the Japanese Patent Office on Nov. 9, 2004, Nov. 15, 2004, and Dec. 28, 2004, respectively, and the entire contents of which are hereby incorporated herein by reference.

BACKGROUND OF THE INVENTION

1. Field of the Invention

The present invention relates to an image forming apparatus developing a latent image on an image bearing member with toner, such as a copier, a printer, a facsimile apparatus, etc., a toner supply device for use in the image forming apparatus, and a toner container for use in the toner supply device.

2. Discussion of the Background

It is well known that a toner container containing toner, such as a toner bottle and a toner cartridge, is set in the main body of an image forming apparatus and the toner is supplied to a development device from the toner container. The toner container of this kind is generally made in a stable shape, so that when the used toner container is recycled for reuse or collected for incineration by a manufacturer, because of its bulk, the logistics costs a great deal.

Further, when recycling the used toner container, cleaning the collected used toner container is not so easy, so that the recycling of the toner container is relatively expensive.

On the other hand, recently, a toner container of a volume compressible type has been proposed. However, such a volume compressible toner container has drawbacks that discharging of toner is not so stable, the freedom in conveying the discharged toner is restricted, the performance and the stability of supplying toner are unsatisfactory, toner scattering is caused in replacement, and the installation location of a toner supply device using the toner container in an image forming apparatus is restricted.

To solve the above-described drawbacks, the applicant of the present invention has proposed to use a suction-type uniaxial eccentric, screw pump, called a Monoe pump, for a toner conveyance device. The pump is constituted of a rotor of a male screw type, which is formed of a material having rigidity, such as metal, in an eccentric screw shape, a stator of a female screw, the inside of which is formed in a two-fold screw shape by an elastic material, such as rubber, and which is fixedly set, and a holder made of resin, which encloses the rotor and the stator and forms a conveying path for powder, such as toner. The male screw type rotor inserted into the female screw type stator is rotated around the eccentric center via a connection rod connected with a drive device within a hole of an elliptic shape in the cross section of the stator (an eccentric rotation space). Thereby, a pumping function (a strong self-priming force and a suction pressure) is generated, and toner is sucked into the stator and is discharged through the stator. The toner is fluidized by supplying compressed air before being sucked and after having been discharged by an air supply device.

Japanese Patent Laid-open publication No. 2001-324863 describes a toner container for use in an image forming apparatus using such a Monoe pump. The toner container includes a container bag in a hermetic state, which is deformable by a suction pressure of the Monoe pump. A self-closing valve made of a seal member is provided to an opening part of the container bag, and a cap member provided with a toner discharge part is attached to a tip end of the container bag.

SUMMARY OF THE INVENTION

The present invention has been made in views of the above-discussed and other problems and addresses the above-discussed and other problems.

Preferred embodiments of the present invention provide a novel toner container provided with a toner bag and a cap member, in which toner leakage is avoided, a novel toner supply device using the toner container, and an image forming apparatus using the toner container.

According to an embodiment of the present invention, a toner container for installation in a toner supply device is provided. The toner container includes a toner accommodation member and a cap member freely attachable to and detachable from the toner accommodation member. The toner accommodation member includes a bag member having an opening, and a connection member attached to the opening of the bag member and having a toner supply opening. The cap member is configured to receive toner supplied from the toner supply opening of the connection member of the toner accommodation member and to discharge the received toner. Either of the connection member of the toner accommodation member and the cap member includes a groove part and the other includes a protrusion part to engage with the groove part, and the cap member is attached to the toner accommodation member by engaging the groove part and the protrusion part with each other. The protrusion part elastically deforms to engage with the groove part.

In the toner container, the cap member may engage with the toner supply opening of the connection member through the intermediary of an elastic member. The elastic member closely contacts either of the cap member and the connection member at least at two or more places.

Further, in the toner container, the protrusion part may engage with the groove part along a longitudinal direction of the groove part, and a tip end part in the longitudinal direction of the groove part may be formed broader than an inner side of the groove part. An internal surface of an end part of the groove part may be formed in a tapered shape to be narrower toward the inner side of the groove part from the tip end part thereof.

Furthermore, in the toner container, a tip end part in a longitudinal direction of the protrusion part may be narrower than a base part side thereof. An end part of an outer border of the protrusion part may be formed in a tapered shape to be broader toward the base part side of the protrusion part from the tip end part thereof.

Still further, in the toner container, the protrusion part may be formed to engage with the groove part by rotating the cap member relative to the connection member.

Still further, in the toner container, the connection member and the cap member may include a lock mechanism configured such that the protrusion part is held at the groove part at a position after the protrusion part has been moved along a longitudinal direction of the groove part a predetermined distance relative to the groove part. The lock mechanism may be configured such that engagement of the protrusion part and the groove part is released using a jig.

Still further, in the toner container, the cap member may include a cylindrical valve room having a toner discharge opening at least at one end thereof, a communication hole communicating with the toner supply opening of the toner accommodation member and the valve room, and a cylindrical valve member movable in the valve room, and the valve room may be configured such that a toner supply path from the communication hole to the toner discharge opening is opened and closed by moving the valve member in an axial direction of the valve room. The toner container may include an O-ring arranged at an end part of the valve room of the cap member to seal the toner supply path. The O-ring may include a tapered part thinner in a width in a direction parallel to an axis of the valve room of the cap member toward an internal circumferential surface side from an outer circumferential surface side thereof. The tapered part faces an opening of the O-ring formed by the internal circumferential surface of the O-ring. A tip end part of the tapered part of the O-ring may be located within the valve room of the cap member and a base part continuing from the tapered part of the O-ring may be located outside of the valve room.

According to another embodiment of the present invention, a toner supply device includes the above-described toner container and a toner conveyance device configured to convey toner from the toner container.

According to another embodiment of the present invention, a toner supply device includes a toner container set part configured to attach the above-described toner container, and a toner conveyance device configured to convey toner from the toner container attached to the toner container set part.

According to still another embodiment of the present invention, an image forming apparatus includes a development device and the above-described toner container for containing toner to be supplied to the development device.

According to still another preferred embodiment of the present invention, an image forming apparatus includes a development, device and the above-described toner supply device configured to supply toner to the development device.

BRIEF DESCRIPTION OF THE DRAWINGS

A more complete appreciation of the present invention and many of the attended advantages thereof will be readily obtained as the present invention becomes better understood by reference to the following detailed description when considered in connection with the accompanying drawings, wherein.

DETAILED DESCRIPTION OF THE PREFERRED EMBODIMENTS

Figure 1:
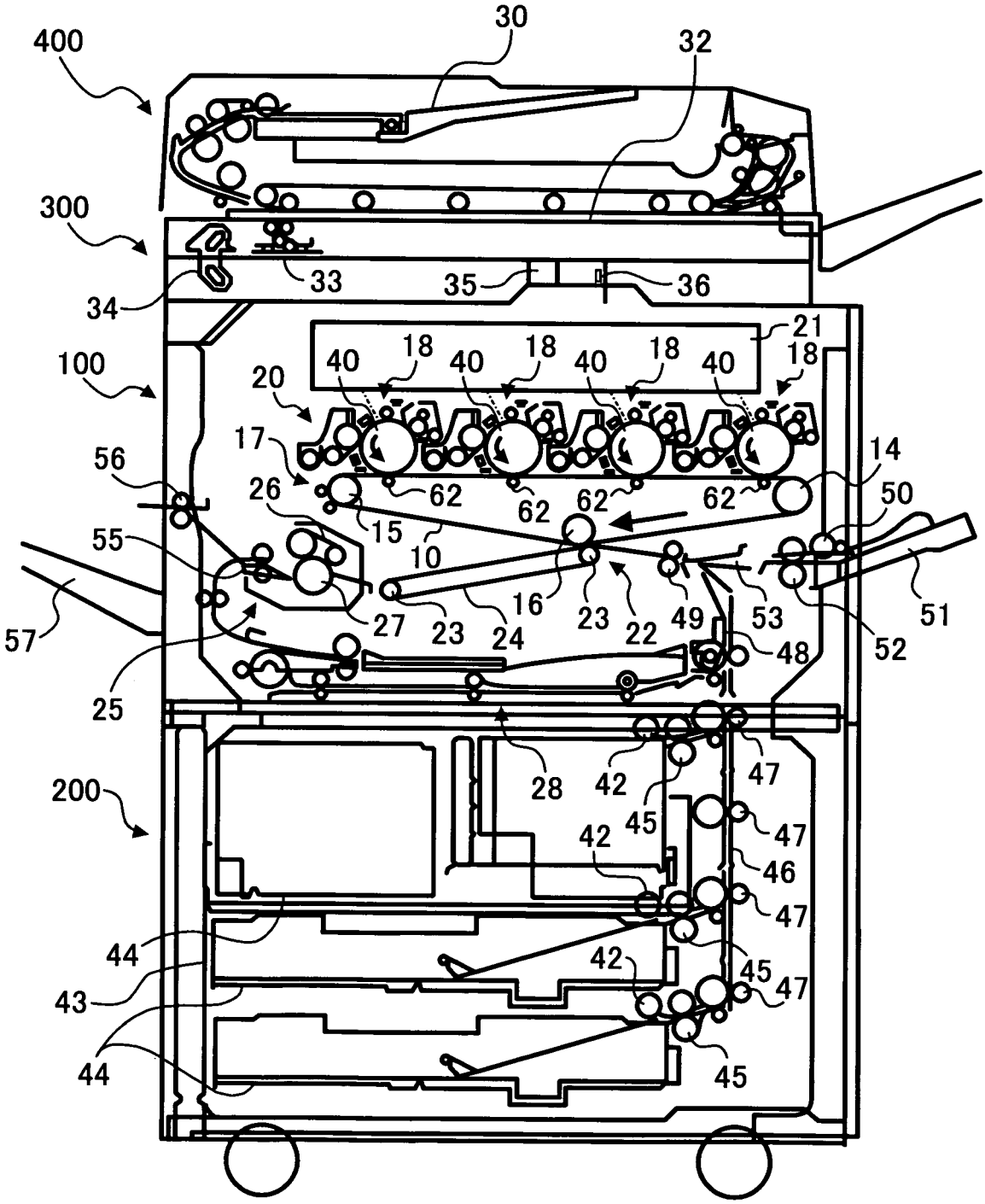
FIG. 1 is a diagram schematically illustrating an image forming apparatus according to an embodiment of the present invention.

Referring now to the drawings, wherein like reference numerals designate identical or corresponding parts throughout the several views, preferred embodiments of the present invention are described.

FIG. 1 illustrates a tandem-type color copier of an indirect transfer system as an image forming apparatus according to an embodiment of the present invention. The present invention can be applied to a tandem-type color copier of a direct transfer system, a revolver-type color copier, and a black-and-white copier. In FIG. 1, a reference numeral 100 denotes the main body of the color copier, a reference numeral 200 denotes a sheet feed part on which the main body 100 is mounted, a reference numeral 300 denotes a scanner mounted on the main body 100, and a reference numeral 400 denotes an automatic original document feed device (ADF) mounted on the scanner 300.

An endless belt-type intermediary transfer member 10 is provided at the center of the main body 100. The intermediary transfer member 10 may be constructed by providing an elastic layer constituted of a fluorine rubber, an acrylonitrile-butadiene copolymer rubber, etc. on a base layer constituted of a material hard to be extended (e.g., a fluorocarbon resin, a canvas, etc.) and by forming a coat layer having good smoothness on the surface of the elastic layer by coating, for example, a fluorine-family resin. The intermediary transfer member 10 is spanned around first, second and third support rollers 14, 15 and 16, and is conveyed to rotate in the clockwise direction in FIG. 1.

An intermediary transfer member cleaning device 17 is arranged at the left side of the second support roller 15 to remove residual toner remaining on the intermediary transfer member 10 after transfer of an image. Four image formation devices 18 for black, yellow, magenta, and cyan are arranged side-by-side along the conveying direction of the intermediary transfer member 10 above the part of the intermediary transfer member 10 spanned by and extended between the first support roller 14 and the second support roller 15, and thereby a tandem image formation device 20 is constructed. Further, an exposure device 21 is arranged above the tandem image formation device 20, and a secondary transfer device 22 is arranged at the opposite side of the intermediary transfer member 10 (opposite the side where the tandem image formation device 20 is arranged) The secondary transfer device 22 is constructed by spanning an endless secondary transfer belt 24 around two rollers 23, and is arranged to be pressed against the third support roller 16 via the intermediary transfer member 10. An image on the intermediary transfer member 10 is transferred onto a sheet passing through a nip part of the intermediary transfer member 10 and the secondary transfer belt 24.

A fixing device 25 is provided next to the secondary transfer device 22 to fix the transferred image onto the sheet. The fixing device 25 is configured such that a pressure roller 27 is pressed against an endless fixing belt 26. The secondary transfer device 22 conveys the sheet passed through the nip part of the intermediary transfer member 10 and the secondary transfer belt 24 and carrying the transferred image thereon to the fixing device 25. A non-contact type charger may be used for the secondary transfer device 22. In this case, a sheet conveying device may be arranged to convey the sheet passed through the nip part of the intermediary transfer member 10 and the secondary transfer belt 24 to the fixing device 25.

A sheet reverse device 28 is arranged below the secondary transfer device 22 and the fixing device 25 in parallel to the tandem image formation device 20 to reverse the sheet carrying the transferred image thereupon (on one side of the sheet) so that another image is transferred onto the other side of the sheet.

When obtaining a copy of an original document using the above-described color copier, the original document is set on an original document plate 30 of the ADF 400, or the original document is set on a contact glass 32 of the scanner 30 by opening the ADF 400 and is then pressed against the contact glass 32 by closing the ADF 400. By depressing a start button (not shown) when the original document has been set on the ADF 400, the scanner 300 is driven after conveying the original document onto the contact glass 32, and when the original document has been set on the contact glass 32, the scanner 300 is driven immediately, and a first travel member 33 and a second travel member 34 are driven to move. The first travel member 33 emits a light, and reflects a reflected light from the surface of the original document toward the second travel member 34. A mirror of the second travel member 34 reflects the light reflected from the surface of the original document toward an image formation lens 35. The light passes the image formation lens 35 and is received by a reading sensor 36, and thereby the image information of the original document is read with the reading sensor 36.

By depressing the start button, a drive motor (not shown) drives one of the support rollers 14, 15, and 16 to rotate, and thereby the other two support rollers are driven, and thereby the intermediary transfer member 10 is conveyed to rotate. At the same time, the photoconductors 40 of the image formation devices 18 are rotated, and a black image, a yellow image, a magenta image, and a cyan image are formed thereupon, respectively. As the intermediary transfer member 10 is conveyed, these images are sequentially transferred onto the intermediary transfer member 10 to be superimposed on top of each other, so that a full color image is formed on the intermediary transfer member 10.

Meanwhile, by depressing the start button, one of feed rollers 42 of the sheet feed part 200 is selectively rotated to feed a sheet from one of sheet cassettes 44 provided in a multistage paper bank 43. The sheet is fed out one by one by a separation roller 45 from the sheet cassette 44 to be conveyed to a sheet feed path 46. The sheet is conveyed by convey rollers 47 to a feed path 48 in the main body 100, and impinges on a registration roller 49 to be stopped. When manually inserting a sheet from a manual insertion table 51, by rotating a feed roller 50, the inserted sheet is conveyed by the feed roller 50 and is conveyed one by one by a separation roller 52 to a manual sheet conveying path 53. The sheet similarly impinges on the registration roller 49 to be stopped.

The registration roller 49 is rotated in synchronism with the full color image on the intermediary transfer member 10, and the sheet is conveyed into the nip part of the intermediary transfer member 10 and the secondary transfer belt 24 of the secondary transfer device 22. The color image on the intermediary transfer member 10 is transferred onto the sheet by the secondary transfer device 22, so that the color image is formed on the sheet. The sheet is then conveyed to the fixing device 22 by the secondary transfer device 22. The fixing device 22 fixes the color image onto the sheet by applying heat and pressure. Thereafter, a switch claw 55 switches the direction in which the sheet is conveyed toward a discharger roller pair 56 so that the sheet is discharged onto a discharge tray 57 or toward the sheet reverse device 28. The sheet conveyed to the sheet reverse device 28 is reversed, and is guided to the nip part of the intermediary transfer member 10 and the secondary transfer belt 24 of the secondary transfer device 22. After an image is formed on the other side of the sheet, the sheet is discharged onto the discharge tray 57 by the discharge roller 56.

Residual toner remaining on the intermediary transfer member 10 after transferring the color image onto the sheet is removed by the intermediary transfer member cleaning device 17 so that the intermediary transfer member 10 is ready for next image formation by the tandem image formation device 20.

Each image formation device 18 includes a charging device, a development device, a first transfer device 62, a photoconductor cleaning device, and a discharging device, which are arranged around the photoconductor 40 formed in a drum shape. The photoconductor 40 is constituted of a drum made of aluminum on which a photosensitive layer has been formed by coating an organic photoconductive material. The photoconductor 40 may be formed in an endless belt. The construction and the operation of the image formation device 18 are known ones, so that the description is omitted.

Figure 2:
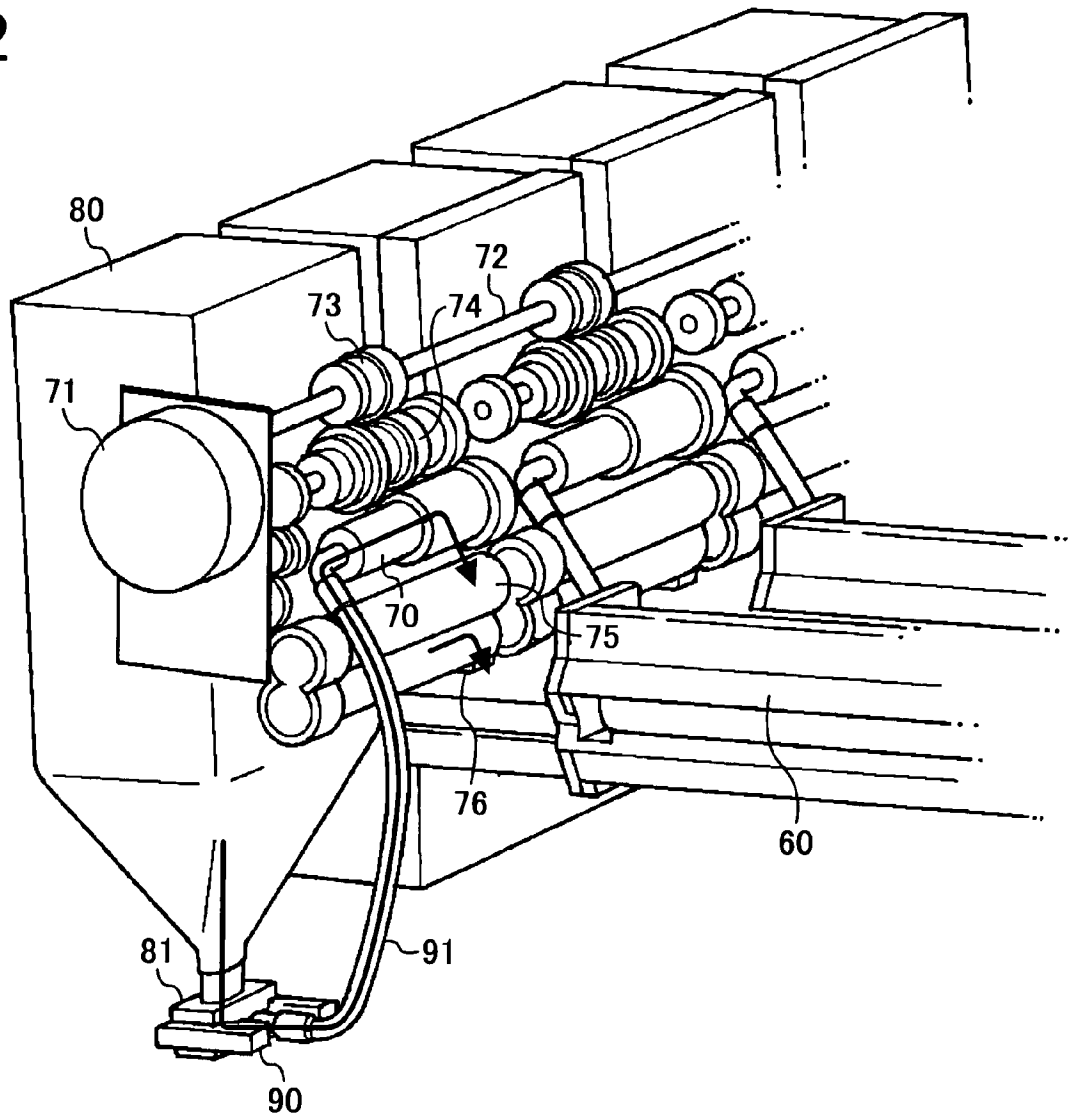
FIG. 2 is a diagram schematically illustrating a toner supply device supplying toner to a development device of the image formation apparatus.

FIG. 2 is a diagram schematically illustrating the construction of a toner supply device provided in the tandem image formation device 20 or the color copier to supply toner to each development device of the image formation device 18. In FIG. 2, a reference numeral 80 denotes a toner container containing toner and a reference numeral 60 denotes the development device. The toner containers 80 containing black toner, magenta toner, cyan toner, and yellow toner, respectively, are provided for corresponding development devices 60. The toner containers 80 are arranged in a toner container set part (described later) provided at the front of the main body 100. The mechanisms of supplying toner from respective toner containers 80 to corresponding development devices 60 are substantially the same, so that the description will be made with respect to the toner container 80 for black and the development device 60 for black at this side in FIG. 2.

A nozzle 90, which is inserted into the toner container 80, is provided in an apparatus frame (not shown), and a powder pump 70 as a toner suction device and the nozzle 90 are connected with each other by a toner conveying tube 91. By setting the toner container 80 to the toner container set part, the tip end of the nozzle 90 is inserted into a valve room (described later) of a cap member 81 attached to a bottom part of the toner container 80, and thereby the toner container 80 and the powder pump 70 communicate with each other. The powder pump 70 is driven via a relay gear 74 by a shaft gear 73 mounted to a drive shaft 72. The drive shaft 72 is driven to rotate by a drive motor 71. A Monoe pump having a known construction is used for the powder pump 70. The toner conveyed by the powder pump 70 is once accommodated in a sub-hopper 75 and is conveyed to the development device 60 through a toner supply opening 76 provided to a bottom part of the sub-hopper 75. In FIG. 2, the flow of toner from the toner container 80 to the development device 60 is indicated with arrows.

Figure 3:
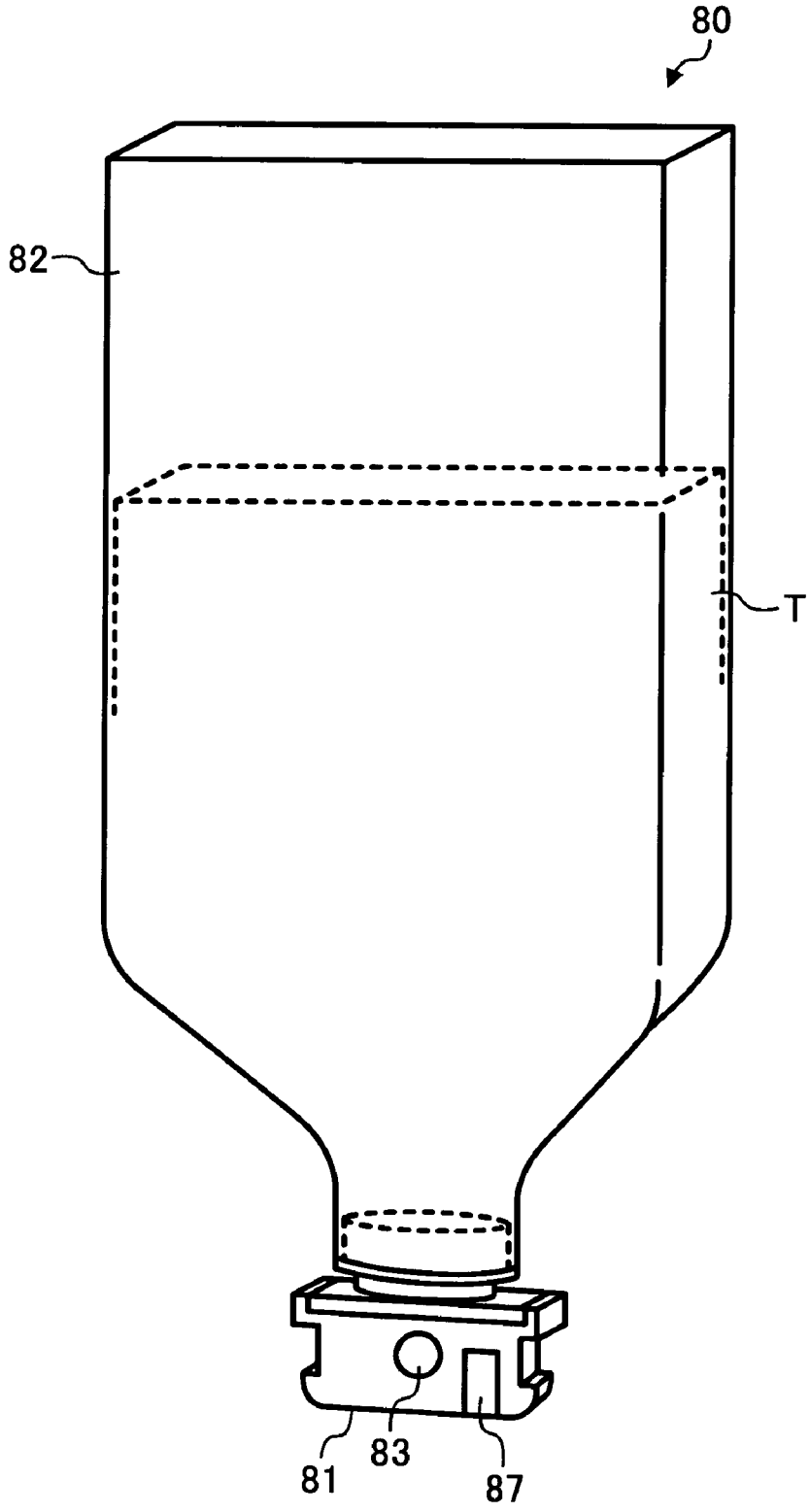
FIG. 3 is a diagram illustrating the construction of a toner container according to an embodiment of the present invention.

FIG. 3 is a diagram illustrating the construction of the toner container 80. The toner container 80 includes, as illustrated in FIG. 3, a toner accommodation member 82 accommodating toner T inside, and the cap member 81 attached to the toner accommodation member 82.

An information record member 87 (e.g., a memory chip) is arranged at the side surface of the cap member 81 so that the information as to the toner container 80 and the contained toner is held. Information, such as, the model of an image forming apparatus conforming with the contained toner, the color of the toner, the manufacture date of the toner, the remaining quantity of the contained toner, etc., is recorded in the information record member 87. It is needless to say that a mechanism to read the information recorded in the information record member 87 or a mechanism to write and read information to and from the information record member 87 is provided at the side of the image forming apparatus. Thereby, the management relating to toner can be facilitated.

Figure 4B:
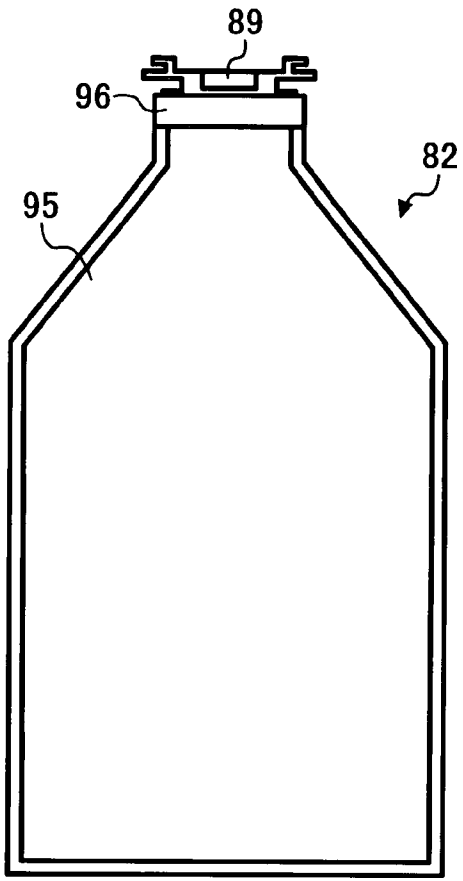
FIG. 4B is a diagram illustrating the toner accommodation member after welding the connection member to the bag member.
Figure 4A:
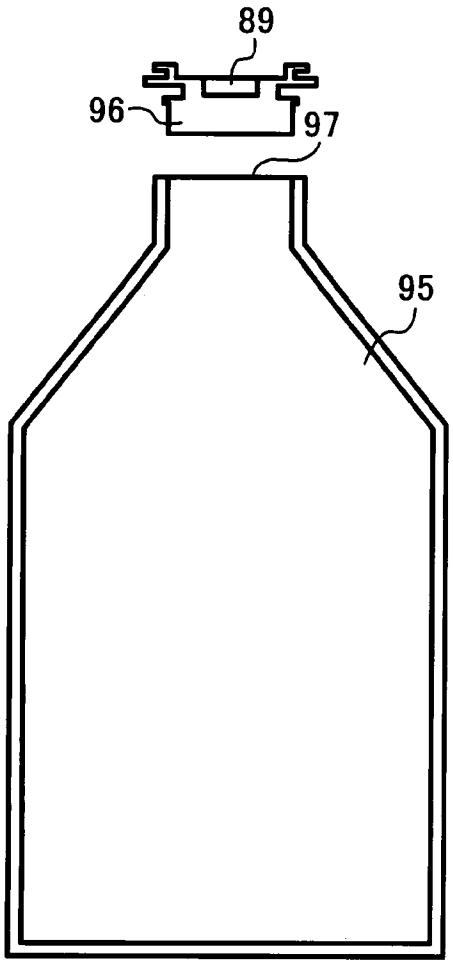
FIG. 4A is a diagram illustrating a toner accommodation member of the toner container before welding a connection member to a bag member.

FIG. 4A and FIG. 4B are diagrams illustrating an exemplary construction of the toner accommodation member 82. In this embodiment, the toner accommodation member 82 includes a bag member 95 formed in a bag shape by welding a resin film of about 50–300 μm in thickness, and a connection member 96 constituted of a rigid material. FIG. 4A illustrates a state before welding the connection member 96 to the bag member 95, and FIG. 4B illustrates a state after welding the connection member 96 to the bag member 95. An opening 97 of the bag member 95 is attached to the connection member 96 by welding, etc. By constituting the bag member 95 of the toner accommodation member 82 by an elastic material, after using up the contained toner, the toner accommodation member 82 can be crumpled small. Thereby, the efficiency in collecting used toner containers 80 can be enhanced. The toner accommodation member 82 may be formed of a molded plastic.

Figure 5:
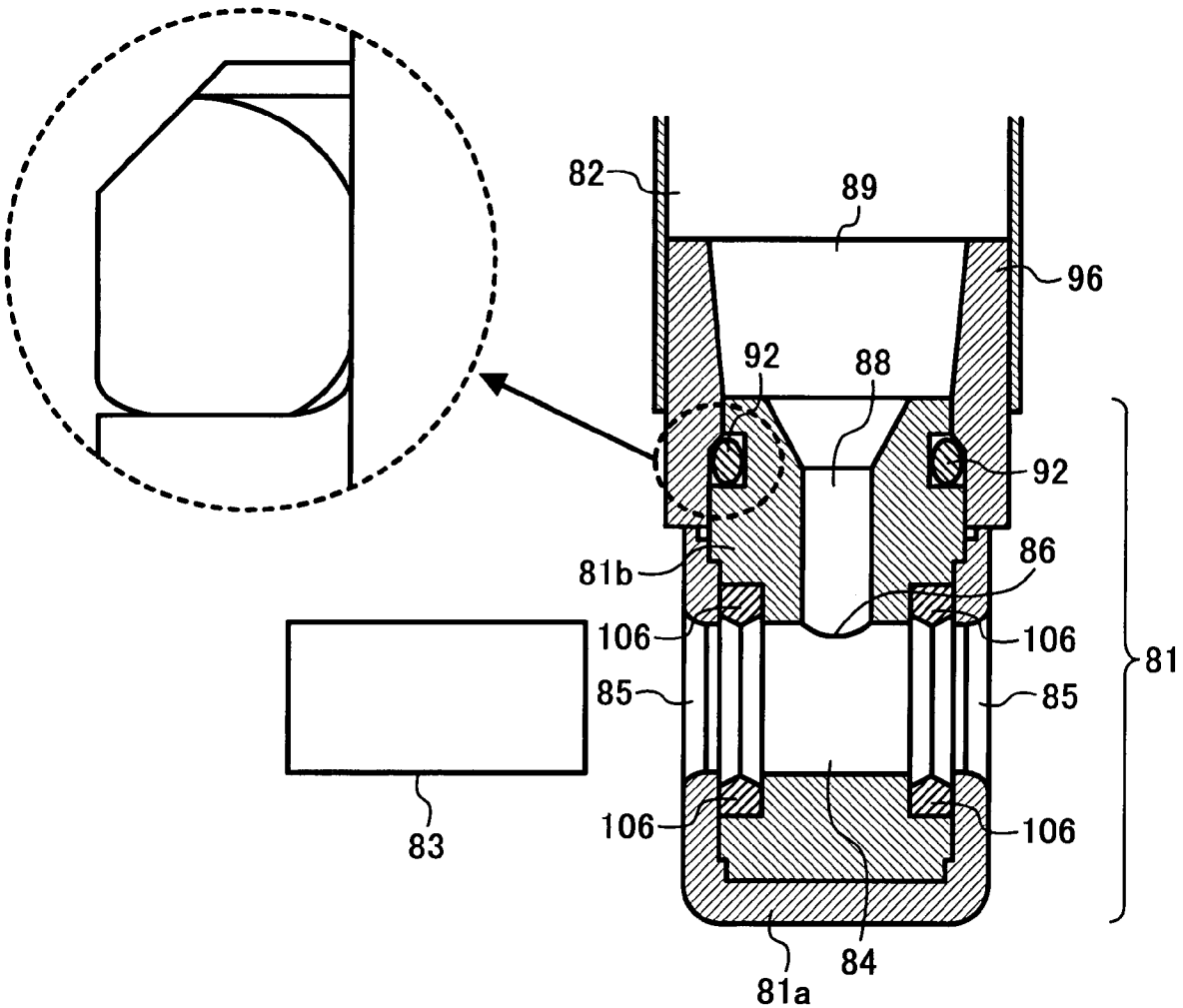
FIG. 5 is an enlarged cross section of a cap member attached to the toner accommodation member of the toner container.

FIG. 5 is an enlarged cross section of the cap member 81 attached to the toner accommodation member 82 of the toner container 80. As can be understood from FIG. 5, a valve room 84 constituted of a space formed in the shape of a cylinder in a recumbent position is provided in the cap member 81, and toner discharge openings 85 are formed at both side ends of the valve room 84 in the central axis direction of the valve room 84. A toner reception opening 86 is formed in the upper circumferential surface of the valve room 84 to communicate with a communication hole 88 communicating with the toner supply opening 89 of the toner accommodation member 82. The toner T accommodated in the toner accommodation member 82 is discharged through the toner supply opening 89 to the communication hole 88.

A valve member 83 which can be inserted into and removed from the valve room 84 is formed in a cylinder shape, and is usually placed within the valve room 84. The valve member 83 is formed such that when inserted into the valve room 84, a predetermined gap is left between the valve member 83 and the internal circumferential surface of the valve room 84. By moving the valve member 83 in the axial direction of the valve room 84 (the horizontal direction in FIG. 5), a toner supply path constituted of the communication hole 88, the toner reception opening 86, the valve room 84, and the toner discharge opening 85 is opened and closed.

Figure 6B:
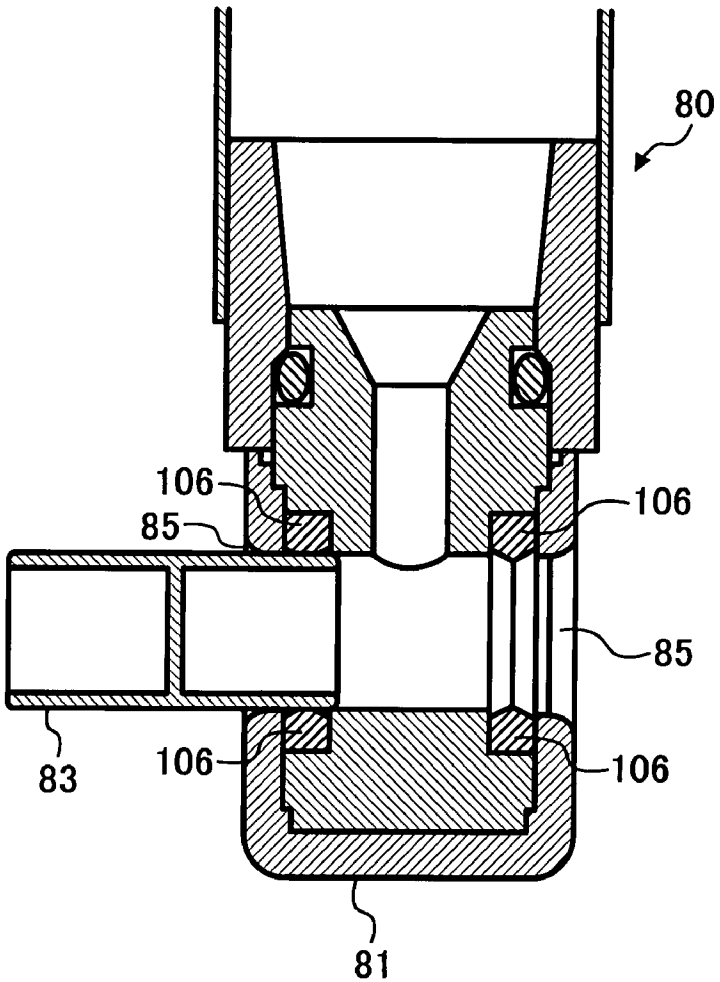
FIG. 6B is a diagram illustrating a state that the valve member has been moved and the toner discharge opening at the right side is opened.
Figure 6A:
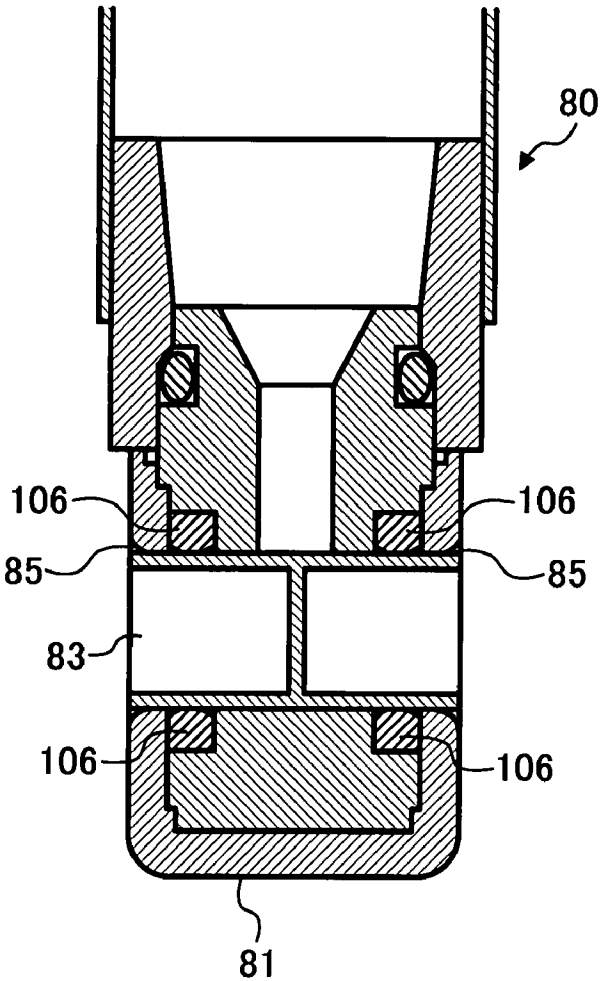
FIG. 6A is a diagram illustrating a state that a valve member is placed within a valve room of the cap member and toner discharge openings at both sides of the valve room are closed by the valve member.

FIG. 6A illustrates a state that the valve member 83 is placed within the valve room 84. In this state, the toner discharge openings 85 at both sides of the valve room 84 are closed with the valve member 83, and thereby the toner supply path is closed. FIG. 6B illustrates a state that the valve member 83 has been moved from the valve room 84. In this state, the toner discharge opening 85 at the right side in figure is opened, and thereby the toner supply path is opened. As described above, by setting the toner container 80 to the toner container set part, the nozzle 90 is inserted into the valve room 84, so that the valve member 83 is moved. Thereby, the toner supply path is opened, and the toner container 80 and the powder pump 70 communicate with each other. In this state, by the operation of the powder pump 70, the toner T accommodated in the toner container 80 is supplied to the development device 60 through the toner supply path, the nozzle 90, and the toner conveying tube 91.

An O-ring 92 constituted of an elastic member, such as rubber, is arranged, as illustrated in FIG. 5, at the upper side circumferential surface of the cap member 81 engaged with the toner accommodation member 82. The O-ring 92 is crushed between the toner accommodation member 82 (the connection member 96) and the cap member 81, and thereby the toner accommodation member 82 is sealed. By inclining a part of the surface of the toner accommodation member 82 engaging with the O-ring 92 by 45 degree for example, the O-ring 92 can be crushed in two directions, horizontally and vertically. Thereby, the toner accommodation member 82 can be more securely sealed, and toner leakage is prevented.

Further, as illustrated in FIG. 5, FIG. 6A, and FIG. 6B, an O-ring 106 is arranged at each end part of the valve room 84, at the immediate inner side of each toner discharge opening 85. The O-ring 106 is made of a volume elastic member, such as rubber. The O-ring 106 is arranged to closely contact the outer circumferential surface of the valve member 83, and thereby the toner container 80 is hermetically sealed. By using the O-ring 106, it is not necessary to manage the gap between the valve member 83 and the internal wall of the valve room 84 so strictly, so that molding of the parts, such as the valve member 83 and the cap member 81, is facilitated. Further, expansion of the parts due to temperature change, and vibration and shock are absorbed by the elasticity of the O-rings 106, so that toner leakage in transit and storage is prevented.

Figure 7:
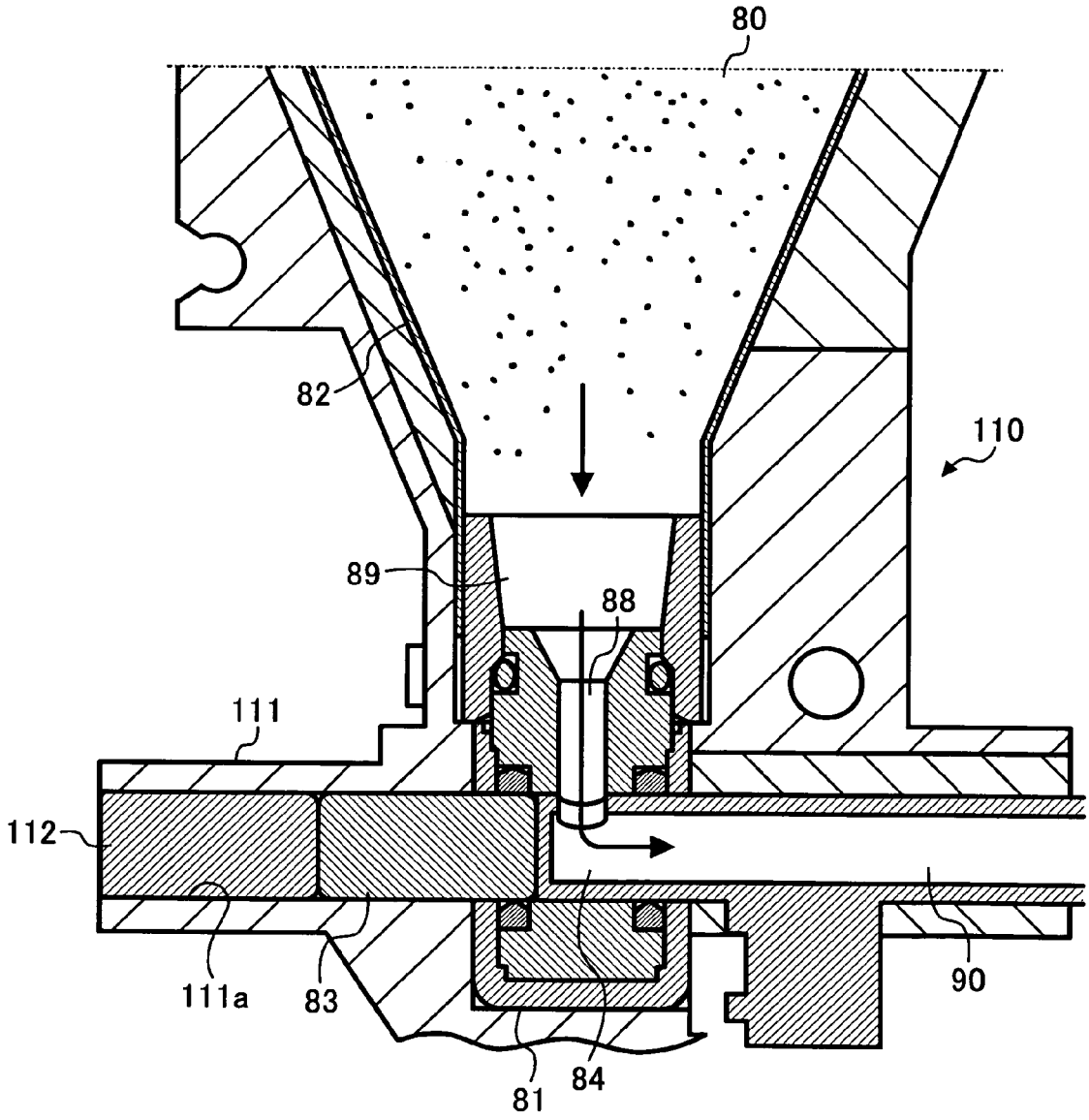
FIG. 7 is a diagram illustrating a state that the toner container has been set to a toner container set part of the main body.

FIG. 7 illustrates a state that the toner container 80 has been set to a toner container set part 110 of the main body 100. The toner container set part 110 is provided to a bottom part of an open/close folder (not shown) provided to the main body 100. A guide tube 111 is provided to a lower part of the toner container set part 110. A pipe path 111*a*, into which the valve member 83 can be inserted when the toner container 80 has been set to the toner container set part 110, is formed inside of the guide tube 111 to face the valve room 84 of the cap member 81. A slider 112 engages with the pipe path 111*a* in a sliding manner. The slider 112 is pressed toward right in FIG. 7 by a compression spring (not shown). A coming-off prevention device (not shown) is provided so that the slider 112 is supported inside of the guide tube 111 even when the slider 112 is pressed by the compression spring.

By setting the toner container 80 to the toner container set part 110, the valve member 83 of the cap member 81 faces the nozzle 90, and by an operation of closing the open/close folder, the nozzle 90 enters into the valve room 84, and the valve member 83 is moved from a toner supply path closing position illustrated in FIG. 6A to a toner supply path opening position illustrated in FIG. 6B and FIG. 7. Thereby, the inside of the toner container 80 communicates with the powder pump 70. When the powder pump 70 is driven in this state, the toner accommodated in the toner container 80 is conveyed through the communication hole 88, the valve room 84, and the nozzle 90, as indicated by the arrow in FIG. 7, and is supplied, via the toner conveying tube 91, to the development device 60 (see FIG. 2 also).

Because the compression spring pressing the slider 112 is compressed by the nozzle 90 entering into the valve room 84, by releasing the open/close folder, the valve member 83 and the nozzle 90 are returned to respective original positions by the elastic force of the compression spring. Thereby, the valve member 83 seals the toner supply path as illustrated in FIG. 6A.

In this embodiment, by providing the toner discharge opening 85 at both sides of the valve room 84 (that is, the valve room 84 penetrates the cap member 81), a mechanism for returning the valve member 83 to the toner supply path closing position can be provided at the side of the main body 100. Therefore, it is not necessary to provide such a mechanism to the toner container 80, so that the cost of the toner container 80 can be decreased. Further, because the toner discharge opening 85 is provided at both sides of the valve room 84, the toner container 80 can be set to the toner container set part 110 by directing either side of the valve room 84 of the cap member 81 toward the nozzle 90, so that the operation easiness of setting the toner container 80 is enhanced.

As can be understood by comparing FIG. 5 and FIG. 7, the toner supply path from the communication hole 88, which communicates with the toner supply opening 89 of the toner container 80, to the toner discharge opening 85 is bent in an "L" shape. Thereby, even when the internal pressure of the toner container 80 is increased due to temperature rise or external pressure decrease in transit, the toner is hard to flow to the toner discharge opening 85, so that toner leakage is prevented. Similarly, even when the toner accommodation member 82 formed in the bag shape is pressed in transit or in replacement, toner leakage is avoided.

When the toner container 80 is not set to the toner container setting part 110 of the main body 100, the toner supply path is closed with the valve member 83, so that the toner is banked up short of the valve member 83 and does not reach the toner discharge opening 85. Further, the valve member 83 is configured to move in the perpendicular direction relative to the direction to face the toner supply opening 89, so that the concern that the valve member 83 is opened by the own weight of the toner facing the toner supply opening 89 is less. Further, even when the internal pressure of the toner container 80 is increased, the valve member 83 is pressed to the internal wall of the valve room 84, so that the friction force between the valve member 83 and the internal wall of the valve room 84 increases. Thereby, the valve member 83 is made hard to move in the valve room 84 and the concern that the valve member 83 comes off due to the internal pressure of the toner container 80 is less.

In this embodiment, as can be understood from FIG. 5, the cap member 81 is constituted of a lower-side member 81*a* and an upper-side member 81*b* including the valve room 84 and the communication hole 88, which are configured to be engaged with each other. However, the cap member 81 can be constituted of an integrated single member. Furthermore, the lower-side member 81*a* may be constituted of a member including the valve room 84 and a separate member supporting the member including the valve room 84.

Figure 8A:
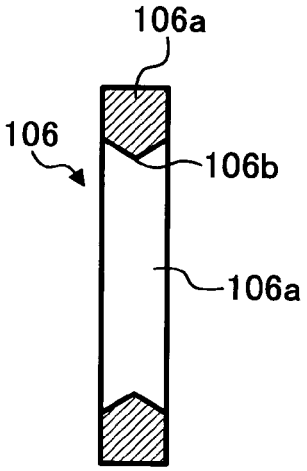
FIG. 8A is a cross section of an O-ring.
Figure 8B:
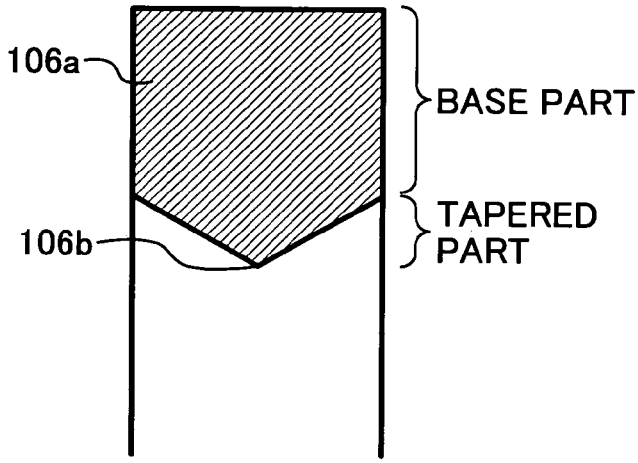
FIG. 8B is an enlarged cross section of a ring part of the O-ring.

FIG. 8A is a cross section of the O-ring 106, and as illustrated, a ring part 106*a* of the O-ring 106 is in a pentagon in its cross section. FIG. 8B is an enlarged cross section of the ring part 106*a*, and as illustrated, the ring part 106*a* includes a base part, and a tapered part formed at the internal circumferential surface side of the base part. An acutely angled tip end part of the tapered part faces a hole part 106*c* of the O-ring 106, as illustrated in FIG. 8A. By forming the ring part 106*a* in its cross section (passing the axis of the O-ring 106) to have a tapered part thinner in the width (in the direction parallel to the axis) from the outer circumferential surface toward the internal circumferential. surface thereof, the contact area of the O-ring 106 relative to the valve member 83 can be decreased without deteriorating the sealing performance of the O-ring 106 and the valve member 83, so that the sliding friction due to the O-ring 106 can be decreased. Thereby, the valve member 83 can be moved easily, so that the operational force of the user for moving the valve member 83 (i.e., the force for closing the open/close folder) can be reduced and the operation easiness can be enhanced.

Further, in this embodiment, the base part of the ring part 106*a* of the O-ring 106 is located outside of the diameter of the valve room 84 (that is, only the tapered part of the ring part 106*a* of the O-ring 106 is within the diameter of the valve room 84), so that the base part of the ring part 106*a* of the O-ring 106 does not contact the valve member 83. Thereby, the contact area of the O-ring 106 relative to the valve member 83 is decreased and the sliding friction due to the O-ring 106 is decreased. Thereby, the valve member 83 can be moved easily, so that the operational force by the user can be further reduced and the operation easiness can be further enhanced.

Figure 9A:
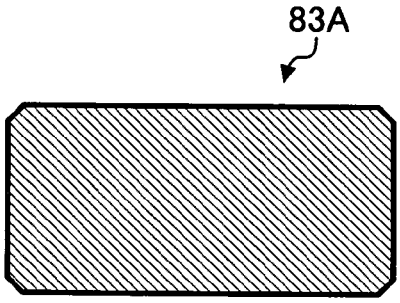
FIG. 9A is a diagram illustrating an exemplary configuration of the valve member.
Figure 9B:
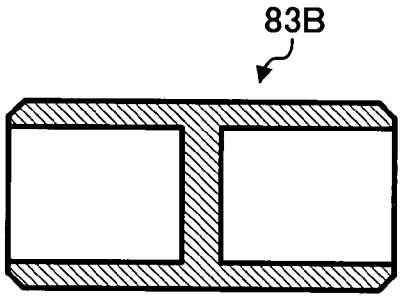
FIG. 9B is a diagram illustrating another exemplary configuration of the valve member.
Figure 9C:
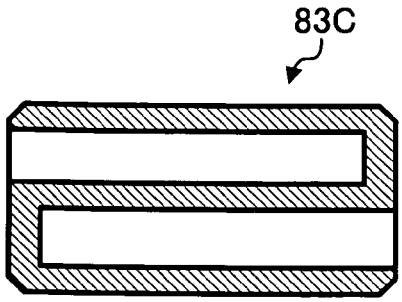
FIG. 9C is a diagram illustrating still another exemplary configuration of the valve member.

FIG. 9A, FIG. 9B, and FIG. 9C illustrate exemplary configurations of the valve member 83, respectively.

FIG. 9A illustrates a solid type valve member 83A formed by metal or rubber. When forming the solid type valve member 83A by an elastic member such as rubber, the sealing property can be held without provision of the O-ring 106 by making the outer diameter of the valve member 83A larger than the diameter of the valve room 84 or by providing a protrusion having the diameter smaller than the outer diameter of the valve member 83A to a part of the valve room 84. Accordingly, in this case, the O-ring 106 can be omitted, so that the number of parts and the cost can be reduced.

FIG. 9B illustrates a valve member 83B formed of a material such as resin, etc. in a hollow pipe shape, in which a partition perpendicular to the axial line thereof is provided at the midpoint thereof. FIG. 9C illustrates a valve member 83C formed of a material such as resin, etc. in a hollow pipe shape, in which a horizontal wall extending in the axial line direction is provided to form a room at each side of the horizontal wall and a partition perpendicular to the axial line is provided at one end side of each room separated by the horizontal wall. The valve member 83B and the valve member 83C, which are in the hollow pipe shape, are relatively light, so that movement thereof is relatively easy. Because both sides of each of the hollow pipe shape valve members 83B and 83C terminate by walls, toner does not pass through the inside of each of the valve member 83B and the valve member 83C, so that toner leakage does not occur.

Figure 10A:
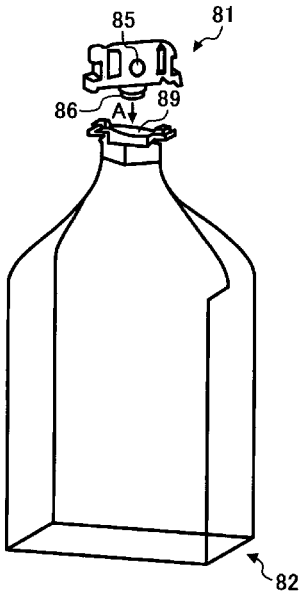
FIG. 10A is a diagram illustrating a state that the cap member is brought to the toner accommodation member to fit into a toner supply opening of the toner accommodation member.
Figure 10B:
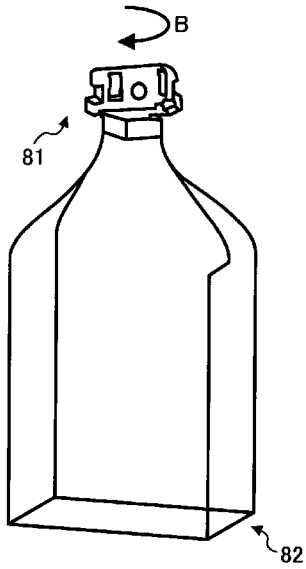
FIG. 10B is a diagram illustrating a state that the cap member is rotated to engage with the toner accommodation member.
Figure 10C:
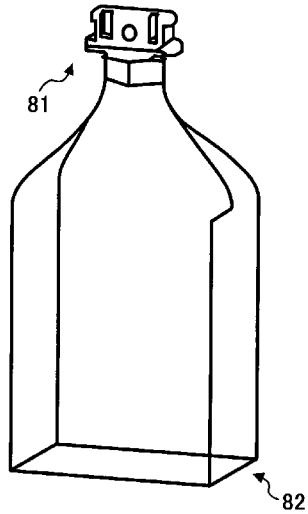
FIG. 10C is a diagram illustrating a state that the cap member has been attached to the toner accommodation member.

FIG. 10A, FIG. 10B, and FIG. 10C are diagrams illustrating a state of attaching the cap member 81 to the toner accommodation member 82. After filling the toner accommodation member 82 with toner, the cap member 81 is brought (in the direction of arrow A in FIG. 10A) close to the toner supply opening 89 of the toner accommodation member 82, and the toner reception opening 86 of the cap member 81 is fit into the toner supply opening 89. Further, as illustrated in FIG. 10B, the cap member 81 is rotated in the direction of arrow B, and thereby the cap member 81 is completely attached to the toner accommodation member 82 as illustrated in FIG. 10C. By performing an operation opposite the above-described one for attachment, the cap member 81 is detached from the toner accommodation member 82. The toner supply opening 89 is completely closed in the state that the toner accommodation member 82 and the cap member 81 are engaged with each other, so that in this state, toner leakage does not occur.

Because the cap member 81 faces the toner supply opening 89 of the toner accommodation member 82 and the direction in which the toner reception opening 86 of the cap member 81 is fit into the toner supply opening 89 (the direction of arrow A in FIG. 10A) is different from the direction in which the cap member 81 is rotated to be attached to the toner accommodation member 82 (the direction of arrow B in FIG. 10B), the concern that the cap member 81 comes off due to the own weight of the toner container 80 and that of the contained toner is less. Further, even when vibration in transit or shock when the toner container 80 has been fallen is given to the toner container 80 in the direction of detaching the cap member 81, unless a force is applied to the toner container 80 at the same time in the direction of releasing the toner reception opening 86 of the cap member 81 from the toner supply opening 89 of the toner accommodation member 82, the cap member 81 will not come off the toner accommodation member 82. Thereby, the concern that the cap member 81 comes off due to an external force is less. In particular, in this embodiment, the cap member 81 is rotated to be detached, and it is very rare that the vibration in transit or the shock when the toner container 80 has been fallen is given to the toner container 80 in the direction of detaching the cap member 81, that is, in the direction in which the cap member 81 is rotated to be detached.

Further, when the internal pressure of the toner container 80 increases due to temperature rise or outside air pressure drop, a force may act on the cap member 81 in the direction of releasing the engagement of the cap member 81 with the toner accommodation member 82 (the direction opposite the direction of arrow A in FIG. 10A). However, in this embodiment, the cap member 81 is detached from the toner accommodation member 82 by being rotated in the opposite direction of arrow B in FIG. 10B, that is, in the direction perpendicular to the direction in which the above-described force may act on the cap member 81. Therefore, the concern that the cap member 81 comes off is less.

When a cap member of a toner container includes a shutter and the shutter is configured to open by an operation of depressing or drawing the shutter, it often occurs when the user holds the toner container that the shutter is erroneously depressed or drawn and thereby the shutter is opened. In this embodiment, however, the cap member 81 is not depressed or drawn when the cap member 81 is operated, so that the possibility that the cap member 81 comes off by an erroneous operation by the user is less. When a cap member is formed in a cylinder shape and protrudes, it also occurs often that the cap member is erroneously operated. However, in this embodiment, the cap member 81 is formed rather in a rectangular parallelepiped shape, so that the possibility that the user erroneously rotates the cap member 81 is less as compared with a case that the cap member 81 is formed in a cylinder shape and protrudes.

Figure 11:
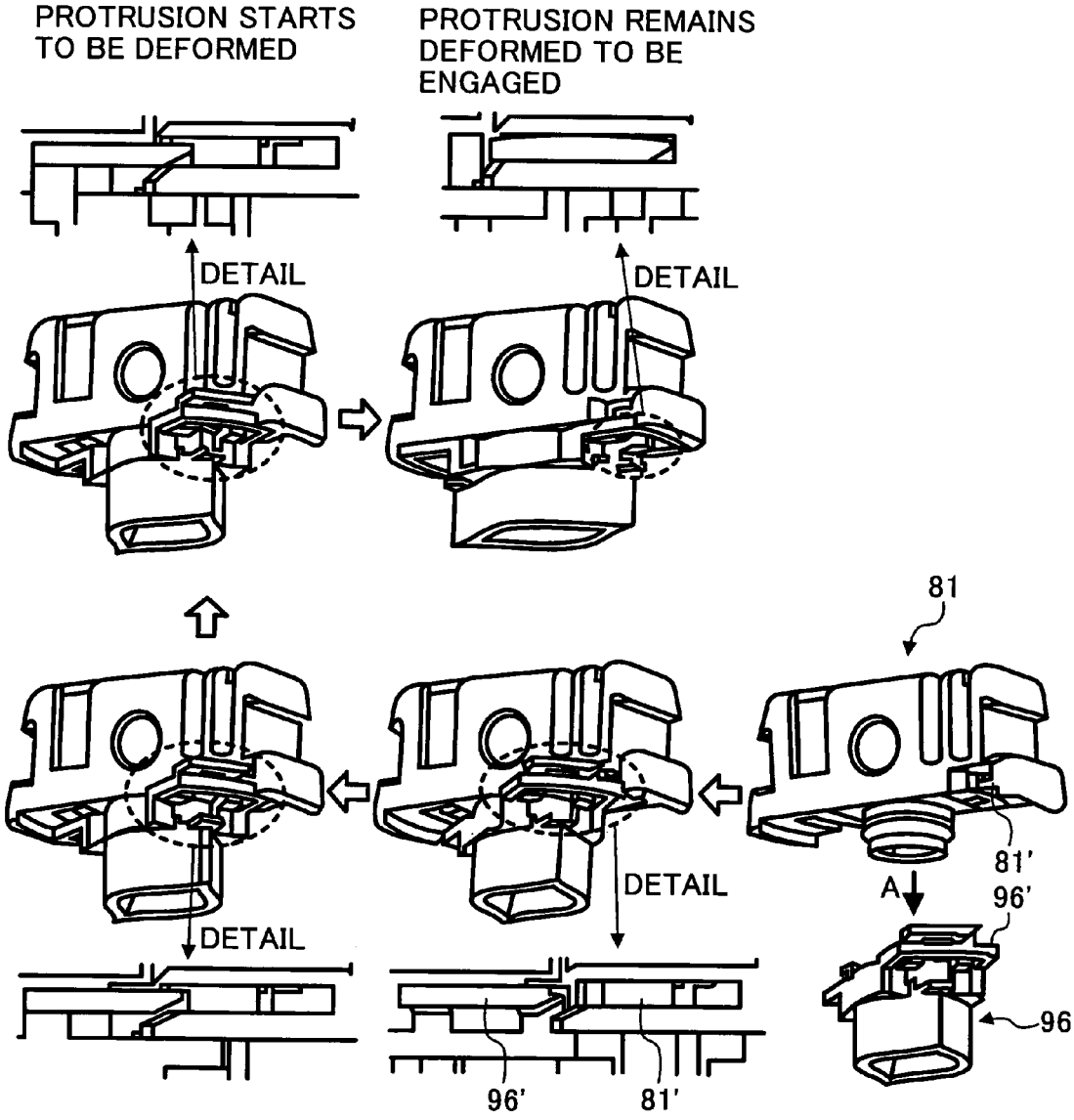
FIG. 11 is a diagram illustrating a state of attaching the cap member to the toner supply opening of a connection member attached to the toner accommodation member over time.

Now, the mechanism of securely attaching the cap member 81 to the toner accommodation member 82 is described. FIG. 11 illustrates a state of attaching the cap member 81 to the toner supply opening 89 of the connection member 96 over time. A laterally protruding protrusion part 96' of the connection member 96 is formed in a two-step protrusion in a one-sided support state. A lateral groove part (concave and convex part) 81' is formed at a corresponding part of the cap member 81 to face inward. The shape of the protrusion part 96' is not limited to the one illustrated in figure. As long as the protrusion part 96' can be elastically deformed by applying a load thereto, the protrusion part 96' can be formed in any shape. However, the shape of the protrusion part 96' must be such that the protrusion part 96' engages with the cap member 81 when attaching the cap member 81 to the toner supply opening 89 of the connection member 96.

Figure 12A:
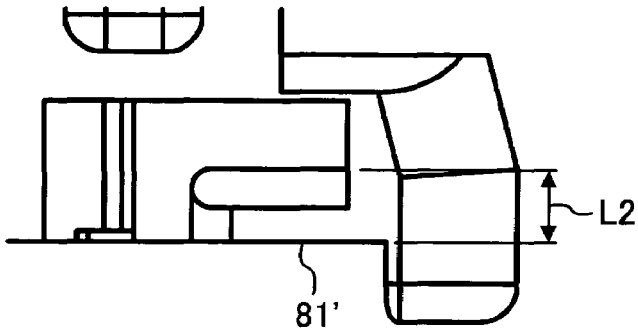
FIG. 12A is a diagram illustrating a groove part of the cap member.
Figure 12B:
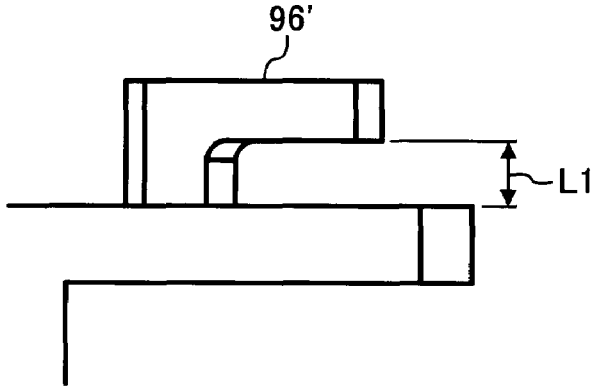
FIG. 12B is a diagram illustrating a protrusion part of the connection member.
Figure 12C:
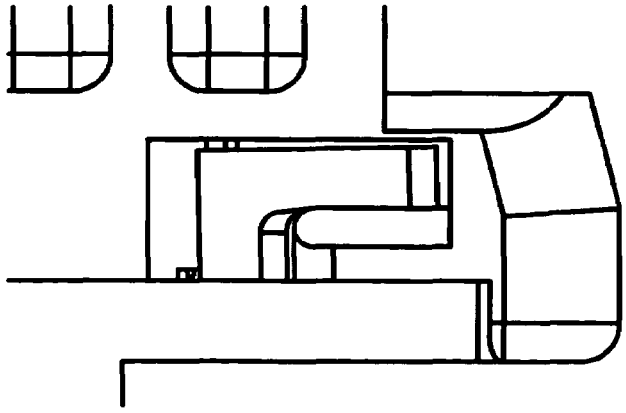
FIG. 12C is a diagram illustrating a state that the groove part and the protrusion part are engaged with each other.

FIG. 12A illustrates the groove part 81' of the cap member 81, FIG. 12B illustrates the protrusion part 96' of the connection member 96, and FIG. 12C illustrates a state that the groove part 81' and the protrusion part 96' are engaged with each other. A convex part width L2 of the groove part 81' and an interspace width L1 of the protrusion part 96' satisfy a relation of $L1 \leqq L2$. The protrusion part 96' is engaged with the groove part 81' by being elastically deformed such that the interspace expands. When the connection member 96 and the cap member 81 are engaged with each other, due to the elastic force of the protrusion part 96', the force of thrusting the connection member 96 and the cap member 81 against each other always acts, so that the cap member 81 is hard to come off the connection member 96, and thereby toner leakage is prevented. It is preferable to use a material easily deformable elastically for the connection member 96. In this embodiment, polyethylene is used.

By making a tip end part in the longitudinal direction of the protrusion part 96' narrower than a base part side thereof or by making a tip end part in the longitudinal direction of the groove part 81' broader than an inner side thereof, when the protrusion part 96' starts to engage with the groove part 81' in attaching the cap member 81 to the connection member 96, the protrusion part 96' and the groove part 81' easily engage with each other. By making the tip end part of the protrusion part 96' narrower as described above and the tip end part of the groove part 81' broader as described above, the protrusion part 96' and the groove part 81' more easily engage with each other.

Figure 13A:
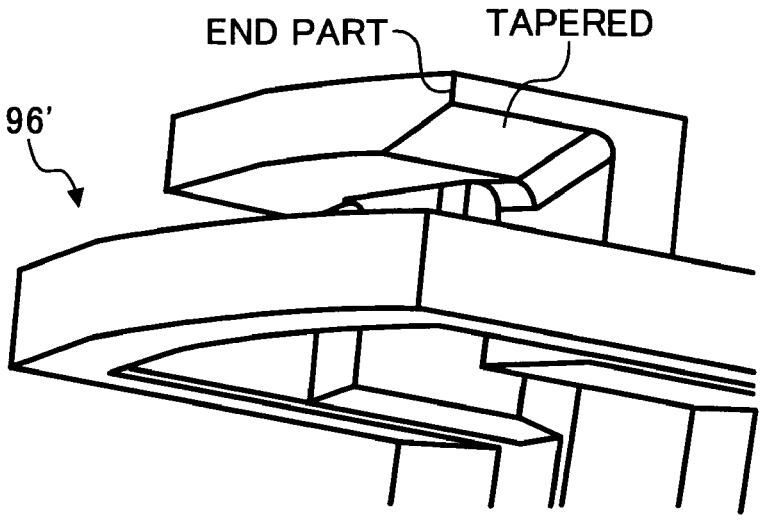
FIG. 13A is a diagram illustrating the protrusion part having a tapered end part.
Figure 13B:
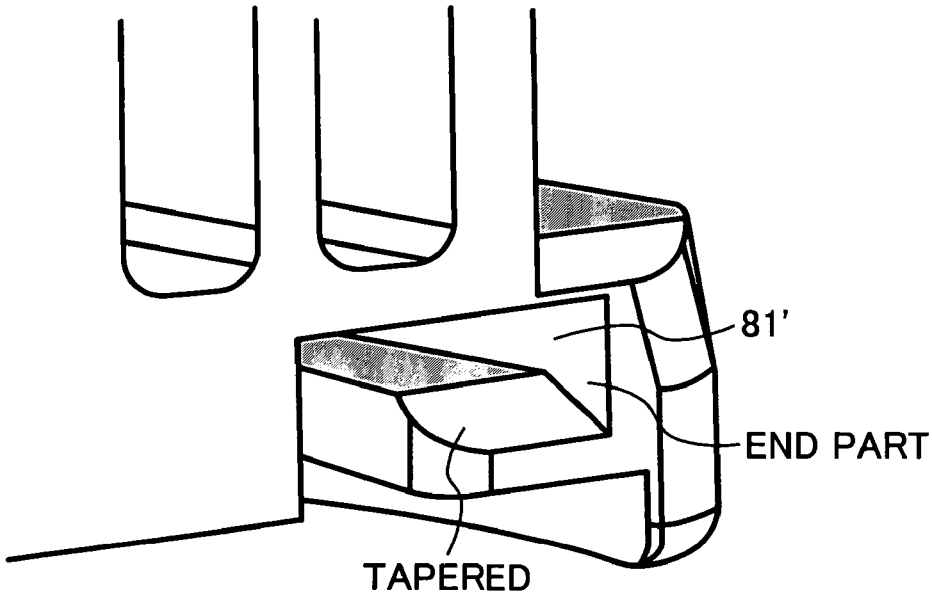
FIG. 13B is a diagram illustrating the groove part having a tapered end part.

Furthermore, by tapering the end part of an outer border of the protrusion part 96' to be thinner toward the tip end part of the protrusion part 96' (broader toward the base part side from the tip end part thereof) as illustrated in FIG. 13A or by tapering the internal surface of the end part of the groove part 81' to be broader toward the tip end part of the groove part 81' (narrower toward the inner side from the tip end part thereof) as illustrated in FIG. 13B, the protrusion part 96' and the groove part 81' smoothly engage with each other. By tapering the end parts of both of the protrusion part 96' and the groove part 81' as described above, the protrusion part 96' and the groove part 81' more smoothly engage with each other.

Thus, as described above referring to FIG. 10A, FIG. 10B, FIG. 10C, and FIG. 11, by fitting the toner reception opening 86 of the cap member 81 into the toner supply opening 89 of the connection member 96 of the toner accommodation member 82 and by rotating the cap member 81 in the direction of arrow B in FIG. 10B, the groove part 81' of the cap member 81 and the protrusion part 96' of the connection member 96 of the toner accommodation member 82 are engaged with each other.

Figure 14A:
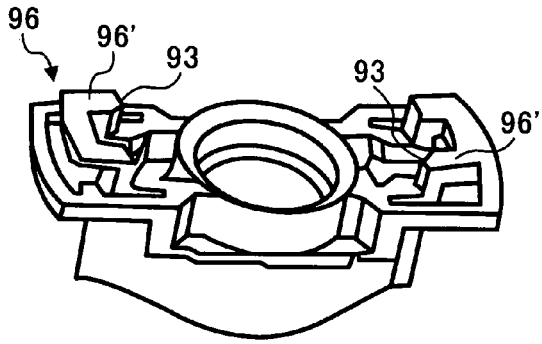
FIG. 14A is a diagram illustrating the protrusion part having a locking part.
Figure 14B:
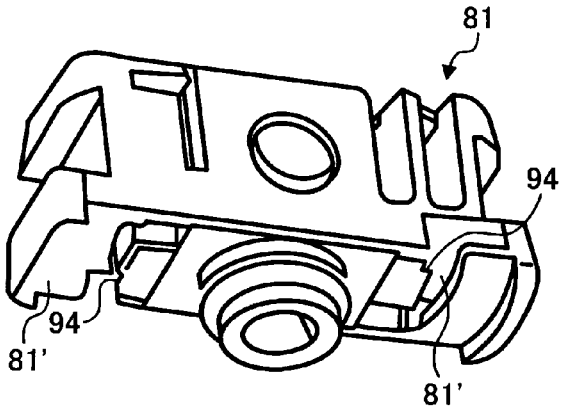
FIG. 14B is a diagram illustrating the groove part having a locking part.
Figure 14C:
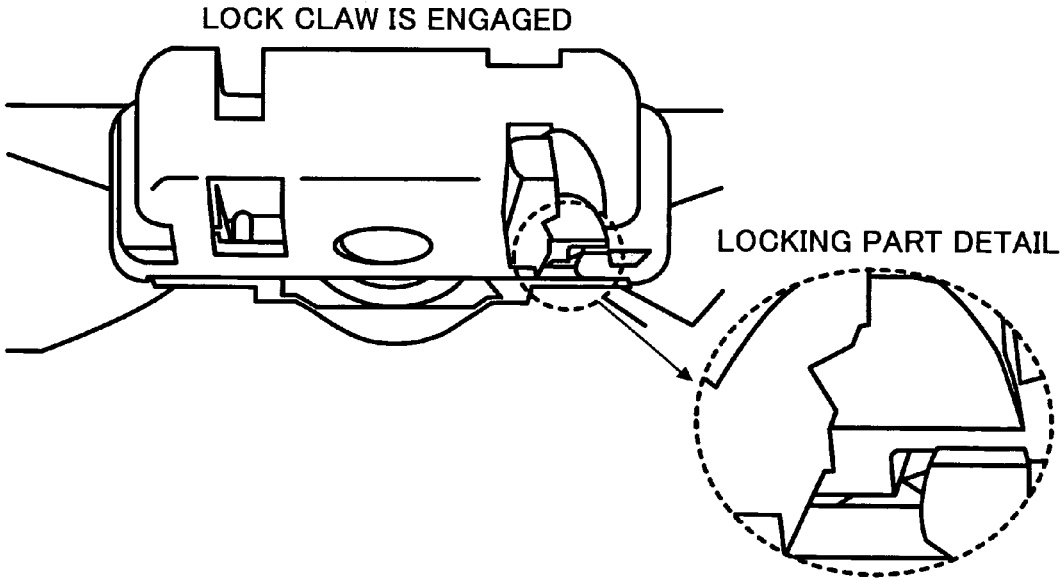
FIG. 14C is a diagram illustrating a state that the locking part of the protrusion part and the locking part of the groove part are engaged with each other.

Furthermore, a lock mechanism may be provided to the protrusion part 96' of the connection member 96 and the groove part 81' of the cap member 81. FIG. 14A illustrates the connection member 96 in which a lock craw 93 is provided to the protrusion part 96'. FIG. 14B illustrates the groove part 81 in which a lock groove 94 corresponding to the lock craw 93 is provided to the groove part 81'. The lock craw 93 has a triangular profile, and the lock groove 94 is formed in a notch. By rotating the cap member 81 in the direction of arrow B in FIG. 10B, the protrusion part 96' is moved along the longitudinal direction of the groove part 81', and after the protrusion part 96' has been moved a predetermined distance along the longitudinal direction of the groove part 81' relative to the groove part 81', the lock claw 93 and the lock groove 94 are engaged with each other with a click. Thereby, the lock claw 93 is held at the lock claw 94 in that position and attachment of the cap member 81 to the connection member 96 of the toner accommodation member 82 is completed. Because the lock claw 93 and the lock groove 94 are engaged with a click, the completion of attachment can be easily recognized.

Thus, by providing a lock mechanism, such as the one constituted of the lock craw 93 and the lock groove 94 as described above, the cap member 81 is hard to move in the direction in which the cap member 81 is detached from the toner accommodation member 82. Thereby, the concern that the cap member 81 comes off is extremely unlikely. Even when the internal pressure of the toner container 80 is increased to be higher than the external pressure by the own weight of the toner container 80 and that of the contained toner, the lock claw 93 and the lock groove 94 are hardly disengaged. Furthermore, the lock claw 93 and the lock groove 94 will not be disengaged unless a force far greater than the normal operational force of the user is applied, so that the possibility that the cap member 81 is erroneously opened and thereby toner is scattered hardly exists.

After attaching the cap member 81 to the toner accommodation member 82, the need to detach the cap member 81 may arise. When a lock mechanism, such as the one described above, is provided, if the lock claw 93 and the lock groove 94 are disengaged by the backward operation, an excessive load might be applied to the lock claw 93 and thereby the lock groove 94 might be deformed.

Figure 15A:
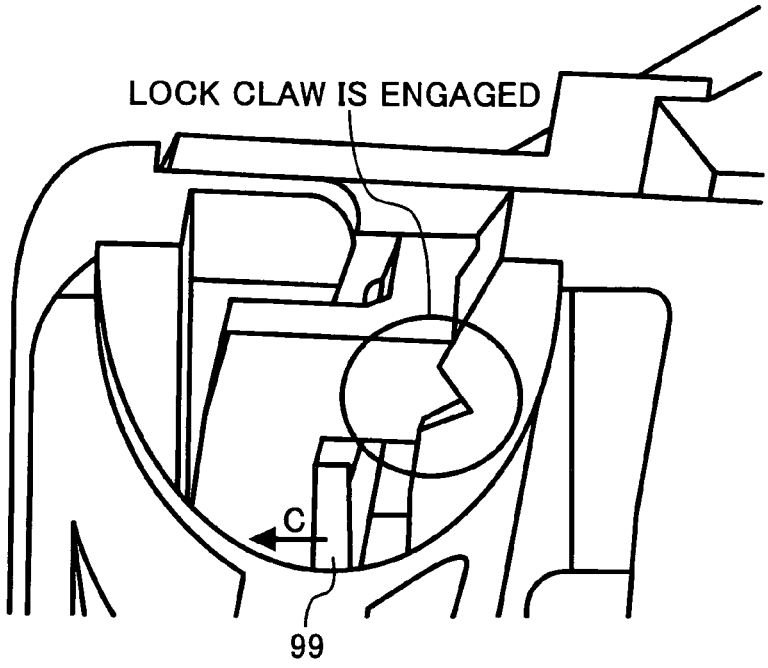
FIG. 15A is a diagram for explaining that engagement of the locking parts of the protrusion part and the groove part is released using a jig.
Figure 15B:
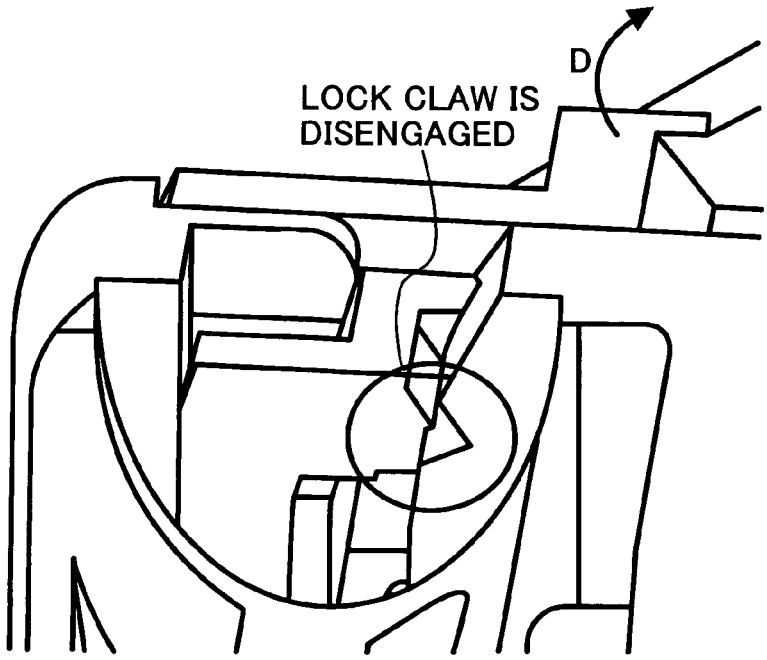
FIG. 15B is a diagram illustrating a state that the engagement of the locking parts has been released.

FIG. 15A and FIG. 15B are diagrams for explaining a method of releasing engagement of the lock claw 93 and the lock groove 94 using a jig. As illustrated in FIG. 15A, the protrusion part 96' is elastically deformed using a jig 99 such that the lock claw 93 is released from the lock groove 94 in the direction of arrow C, and thereafter, the cap member 81 is rotated in the direction of detaching the cap member 81, that is, in the direction of arrow D in FIG. 15B, reverse to the direction of arrow B in FIG. 10B. Thereby, the cap member 81 can be detached without deforming the lock claw 93. Because the lock claw 93 is not deformed, the cap member 81 can be attached again to the toner accommodation member 82, so that the toner container 80 can be used again. When recycling the toner container 80, the cap member 81 may be detached from the toner accommodation member 82 in the above-described manner, and after removing the toner adhering to the inside of the toner accommodation member 82 and filling the toner accommodation member 82 with toner, the cap member 81 may be attached again to the toner accommodation member 82.

Numerous additional modifications and variations of the present invention are possible in light of the above-teachings. It is therefore to be understood that within the scope of the claims, the present invention can be practiced otherwise than as specifically described herein.

What is claimed is:

1. A toner container for installation in a toner supply device, comprising:

a toner accommodation member having an opening, and a connection member attached to the opening and having a toner supply opening; and a cap member freely attachable to and detachable from the toner accommodation member, including a member to be inserted into the toner supply opening of the connection member so that the cap member extends away from the toner accommodation member, and having a cap member opening configured to receive toner supplied from the toner supply opening of the connection member of the toner accommodation member and to discharge the received toner, wherein either of the connection member of the toner accommodation member and the cap member includes a groove part and the other includes a protrusion part to engage with the groove part, and the cap member is attached to the toner accommodation member by engaging the groove part and the protrusion part with each other, and wherein the protrusion part elastically deforms to engage with the groove part.

2. The toner container according to claim 1, wherein the cap member engages with the toner supply opening of the connection member through the intermediary of an elastic member.

3. The toner container according to claim 2, wherein the elastic member closely contacts either of the cap member and the connection member at least at two or more places.

4. The toner container according to claim 1, wherein the protrusion part engages with the groove part along a longitudinal direction of the groove part, and a tip end part in the longitudinal direction of the groove part is formed broader than an inner side of the groove part.

5. The toner container according to claim 4, wherein an internal surface of an end part of the groove part is formed in a tapered shape to be narrower toward the inner side of the groove part from the tip end part thereof.

6. The toner container according to claim 1, wherein the protrusion part engages with the groove part along a longitudinal direction of the groove part, and a tip end part in a longitudinal direction of the protrusion part is narrower than a base part side thereof.

7. The toner container according to claim 6, wherein an end part of an outer border of the protrusion part is formed in a tapered shape to be broader toward the base part side of the protrusion part from the tip end part thereof.

8. The toner container according to claim 1, wherein the protrusion part is formed to engage with the groove part by rotating the cap member relative to the connection member.

9. The toner container according to claim 1, wherein the connection member and the cap member includes a lock mechanism configured such that the protrusion part is held at the groove part at a position after the protrusion part has been moved along a longitudinal direction of the groove part a predetermined distance relative to the groove part.

10. The toner container according to claim 9, wherein the lock mechanism is configured such that engagement of the protrusion part and the groove part is released using a jig.

11. The toner container according to claim 1, wherein the cap member includes a cylindrical valve room having a toner discharge opening at least at one end thereof, a communication hole communicating with the toner supply opening of the toner accommodation member and the valve room, and a cylindrical valve member movable in the valve room, and is configured such that a toner supply path from the communication hole to the toner discharge opening is opened and closed by moving the valve member in an axial direction of the valve room, and wherein the toner container comprises an O-ring arranged at an end part of the valve room of the cap member to seal the toner supply path, the O-ring including a tapered part thinner in a width in a direction parallel to an axis of the valve room toward an internal circumferential surface side from an outer circumferential surface side thereof, the tapered part formed by the internal circumferential surface of the O-ring.

12. The toner container according to claim 11, wherein a tip end part of the tapered part of the O-ring is located within the valve room of the cap member, and a base part continuing from the tapered part of the O-ring is located outside of the valve room.

13. A toner supply device, comprising:

a toner container; and a toner conveyance device configured to convey toner from the toner container, wherein the toner container includes;

a toner accommodation member having an opening, and a connection member attached to the opening and having a toner supply opening;

a cap member freely attachable to and detachable from the toner accommodation member, including a member to be inserted into the toner supply opening of the connection member so that the cap member extends away from the toner accommodation member, and having a cap member opening and configured to receive toner supplied from the toner supply opening of the connection member of the toner accommodation member and to discharge the received toner, wherein either of the connection member of the toner accommodation member and the cap member includes a groove part and the other includes a protrusion part to engage with the groove part, and the cap member is attached to the toner accommodation member by engaging the groove part and the protrusion part with each other, and wherein the protrusion part elastically deforms to engage with the groove part.

14. A toner supply device, comprising:

a toner container;

a toner container set part configured to attach the toner container; and a toner conveyance device configured to convey toner from the toner container attached to the toner container set part, wherein the toner container includes;

a toner accommodation member having an opening, and a connection member attached to the opening and having a toner supply opening;

a cap member freely attachable to and detachable from the toner accommodation member, including a member to be inserted into the toner supply opening of the connection member so that the cap member extends away from the toner accommodation member, and having a cap member opening configured to receive toner supplied from the toner supply opening of the connection member of the toner accommodation member and to discharge the received toner, wherein either of the connection member of the toner accommodation member and the cap member includes a groove part and the other includes a protrusion part to engage with the groove part, and the cap member is attached to the toner accommodation member by engaging the groove part and the protrusion part with each other, and wherein the protrusion part elastically deforms to engage with the groove part.

15. An image forming apparatus, comprising:

a development device; and a toner container for containing toner to be supplied to the development device, wherein the toner container includes;

a toner accommodation member having an opening, and a connection member attached to the opening and having a toner supply opening; and a cap member freely attachable to and detachable from the toner accommodation member, including a member to be inserted into the toner supply opening of the connection member so that the cap member extends away from the toner accommodation member, and having a cap member opening configured to receive toner supplied from the toner supply opening of the connection member of the toner accommodation member and to discharge the received toner, and wherein either of the connection member of the toner accommodation member and the cap member includes a groove part and the other includes a protrusion part to engage with the groove part, and the cap member is attached to the toner accommodation member by engaging the groove part and the protrusion part with each other, and wherein the protrusion part elastically deforms to engage with the groove part.

16. An image forming apparatus, comprising:

a development device; and a toner supply device configured to supply toner to the development device, wherein the toner supply device includes;

a toner container;

a toner container set part configured to attach the toner container; and a toner conveyance device configured to convey toner from the toner container attached to the toner container set part to the development device, and wherein the toner container includes;

a toner accommodation member having an opening, and a connection member attached to the opening and having a toner supply opening; and a cap member freely attachable to and detachable from the toner accommodation member, including a member to be inserted into the toner supply opening of the connection member so that the cap member extends away from the toner accommodation member, and having a cap member opening configured to receive toner supplied from the toner supply opening of the connection member of the toner accommodation member and to discharge the received toner, and wherein either of the connection member of the toner accommodation member and the cap member includes a groove part and the other includes a protrusion part to engage with the groove part, and the cap member is attached to the toner accommodation member by engaging the groove part and the protrusion part with each other, and wherein the protrusion part elastically deforms to engage with the groove part.

17. A toner container comprising:

a toner accommodation member configured to accommodate toner;

a cap member configured to receive toner from the toner accommodation member and to discharge the received toner, wherein the cap member includes a cylindrical valve room having at least one toner discharge opening at least at one end thereof, a communication hole communicating with the toner accommodation member and the valve room, and a cylindrical valve member movable in the valve room, and is configured such that a toner supply path from the communication hole to the toner discharge opening is opened and closed by moving the valve member in an axial direction of the valve room, and wherein the toner container comprises at least one O-ring arranged in the valve room to seal the toner supply path, the O-ring including a tapered part thinner in a width in a direction parallel to an axis of the valve room toward an internal circumferential surface side from an outer circumferential surface side thereof, the tapered part formed by the internal circumferential surface of the O-ring.

18. The toner container according to claim 17, wherein a tip end part of the tapered part of the O-ring is located within the valve room of the cap member, and a base part continuing from the tapered part of the O-ring is located outside of the valve room.

19. The toner container as claimed in claim 17, wherein said at least one toner discharge opening includes a pair of toner discharge openings arranged at both side ends of the valve room, and said at least one O-ring includes a pair of O-rings arranged inside the pair of toner discharge openings in the axial direction.

20. The toner container as claimed in claim 17, wherein said cap member is formed from a lower side unit having the toner discharge opening and an upper side unit having the communication hole and the valve room.

21. The toner container as claimed in claim 19, wherein said valve room allows air tight insertion of an ejection nozzle that conveys the toner to an image forming apparatus via one of the at least two toner discharge openings, said ejection nozzle being movable with its leading end tightly contacting the cylindrical valve member.

22. The toner container according to claim 17, wherein:

the toner accommodation member includes a bag member having an opening, and a connection member attached to the opening of the bag member and having a toner supply opening.

23. The toner container according to claim 17, wherein the cap member is freely attachable to and detachable from the toner accommodation member and configured to receive toner supplied from a toner supply opening of a connection member of the toner accommodation member.

24. The toner container according to claim 22, wherein the cap member includes a communication hole also communicating with the toner supply opening of the toner accommodation member and the valve room.

25. The toner container according to claim 17, wherein the cylindrical valve member is configured such that a toner supply path from the communication hole to a toner discharge opening of the toner accommodation member is opened and closed by moving the valve member in an axial direction of the valve room.

26. The toner container according to claim 17, wherein the at least one O-ring of the toner container is arranged at an end part of the valve room of the cap member to seal the toner supply path.

27. The toner container according to claim 17, further wherein either of the connection member of the toner accommodation member or the cap member includes a groove part and the other includes a protrusion part to engage with the groove part, and the cap member is attached to the toner accommodation member by engaging the groove part and the protrusion part with each other, and wherein the protrusion part elastically deforms to engage with the groove part.

* * * * *